United States Patent [19]

Shatto, Jr.

[11] 4,125,137

[45] Nov. 14, 1978

[54] APPARATUS FOR LOCATING WIRES IN PREDETERMINED CO-PLANAR RELATIONSHIP TO EACH OTHER

[75] Inventor: Walter C. Shatto, Jr., Harrisburg, Pa.

[73] Assignee: AMP Incorporated, Harrisburg, Pa.

[21] Appl. No.: 839,148

[22] Filed: Oct. 3, 1977

[51] Int. Cl.[2] ..... B21F 1/02; H01R 43/00

[52] U.S. Cl. ..... 140/147; 29/749; 29/759

[58] Field of Search ..... 29/749, 750, 751, 753, 29/755, 759; 72/DIG. 10; 140/147

[56] References Cited

U.S. PATENT DOCUMENTS

| | | | |
|---|---|---|---|
| 3,881,246 | 5/1975 | Folk | 29/759 X |
| 3,891,013 | 6/1975 | Folk et al. | 140/147 |
| 3,936,933 | 2/1976 | Folk et al. | 140/147 X |
| 4,043,017 | 8/1977 | Folk et al. | 29/749 |

FOREIGN PATENT DOCUMENTS

| | | | |
|---|---|---|---|
| 1,078,548 | 8/1967 | United Kingdom | 140/147 |

*Primary Examiner*—E. M. Combs

*Attorney, Agent, or Firm*—Anthony S. Volpe; Frederick W. Raring

[57] ABSTRACT

Apparatus for deploying a plurality of wires in predetermined co-planar relationship to each other comprises a templet plate having a plurality of wire-receiving grooves extending thereacross. The grooves diverge from each other so that wires positioned in the grooves will be located in predetermined spaced-apart relationship. The wires are pressed into the grooves by a roller which is movable across the templet plate. In order to control the wires and to ensure proper placement of the wires in the grooves, a controller member is disposed in front of the roller and movable with the roller across the templet. The controller elevates portions of the wires which are adjacent to the roller and approximately aligns the individual wires with the grooves into which they are to be pressed.

9 Claims, 8 Drawing Figures

Fig. 2
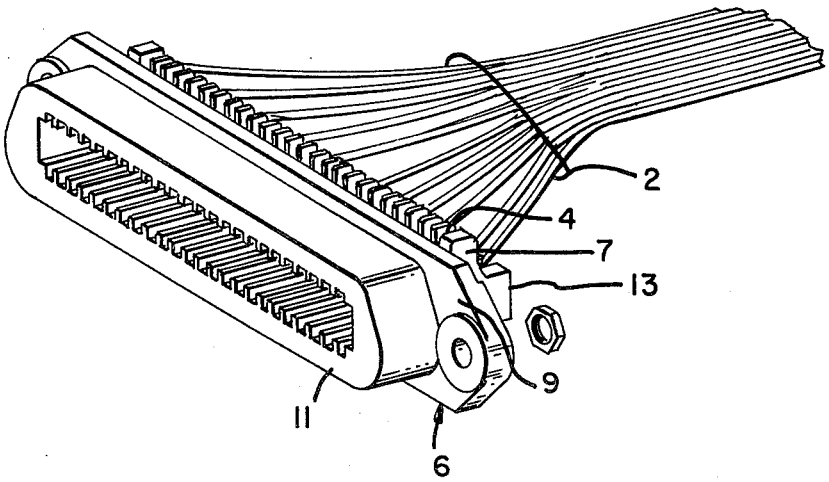
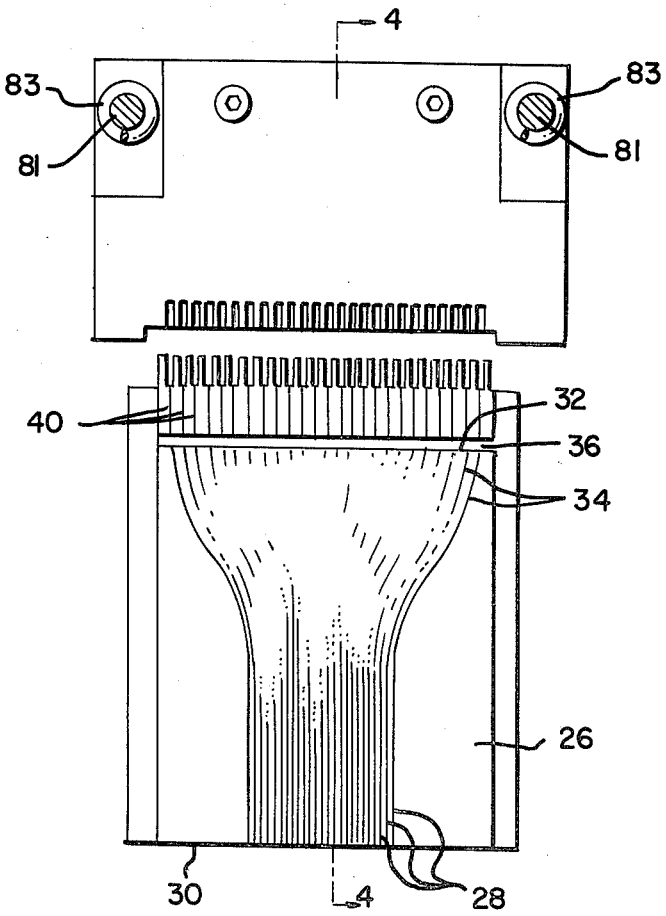
Fig. 3

APPARATUS FOR LOCATING WIRES IN PREDETERMINED CO-PLANAR RELATIONSHIP TO EACH OTHER

BACKGROUND OF THE INVENTION

This invention relates to an improved apparatus for deploying wires and positioning the wires in parallel spaced-apart relationship with respect to each other. The invention is herein disclosed as part of an apparatus for inserting the ends of the wires which have been deployed into the wire-receiving portions of terminals in a connector, however, other uses for the invention will be apparent from the following specification.

U.S. Pat. No. 3,891,013 discloses and claims a wire deploying apparatus comprising a templet having wire-receiving grooves extending thereacross, the form of the grooves defining the final relationship of the wires to each other. The wires are pressed into the grooves by a pressing member, preferably a roller, which moves across the templet and progressively presses the wires into the wire-receiving grooves. This type of wire deploying and locating means has been used in a number of cable making machines and other machines which perform operations on the ends of wires. For example, U.S. Pat. No. 4,043,017 discloses a machine for installing connectors on the ends of a multi-conductor cable having means in accordance with the above-identified U.S. Pat. No. 3,891,013 for locating the wires in alignment with the terminals in the connector.

Under most circumstances, wire deploying and separating devices of the type disclosed in U.S. Pat. No. 3,891,013 are effective to separate the wires and locate the ends of the wires at precise predetermined locations, however, there are circumstances where some operating difficulties and problems are encountered. For example, wires which are extremely stiff or extremely fine will not always align themselves with the grooves into which they are to be pressed as the roller moves across the surface with the result that some of the wires may be pressed into grooves other than the intended grooves. Under some circumstances, the wires may be cut if they extend across a groove in the templet plate resulting in the destruction of a portion of the cable which the wires form. In general, if the wires are in disarray, difficulties may be encountered, particularly, if the apparatus is operated in a careless manner.

In accordance with the teachings of the instant invention, a wire controller is provided in the form of a member which extends across the templet plate and parallel to the wire roller. The wires extend beneath the roller and over the surface of the controller and the controller is movable with the roller across the templet plate. The controller raises portions of the wires which are immediately adjacent to the roller and approximately aligns these portions into grooves into which they are to be pressed. The use of a controller in accordance with the invention minimizes or eliminates problems which have been encountered in the past with stiff wires, fine wires, and tangled or disarrayed wires.

It is accordingly an object of the invention to provide an improved apparatus for deploying wires and positioning the wire ends in spaced-apart co-planar relationship. A further object is to provide a wire deploying apparatus which is capable of deploying wires which are resistant to deployment by previously known methods and apparatus. A further object is to provide a wire deploying apparatus of the type comprising a templet and roller having means for approximately aligning a portion of each wire which is adjacent to the roller with the groove in the templet into which it is to be pressed.

These and other objects of the invention are achieved in a preferred embodiment thereof which are briefly described in the foregoing abstract, which is described in detail below, and which is shown in the accompanying drawing in which:

FIG. 2 is a perspective view of an electrical connector of the type for which the apparatus of FIG. 1 is intended.

FIG. 3 is a plan view of the templet plate in the insertion zone of the apparatus of FIG. 1.

Figure 1:
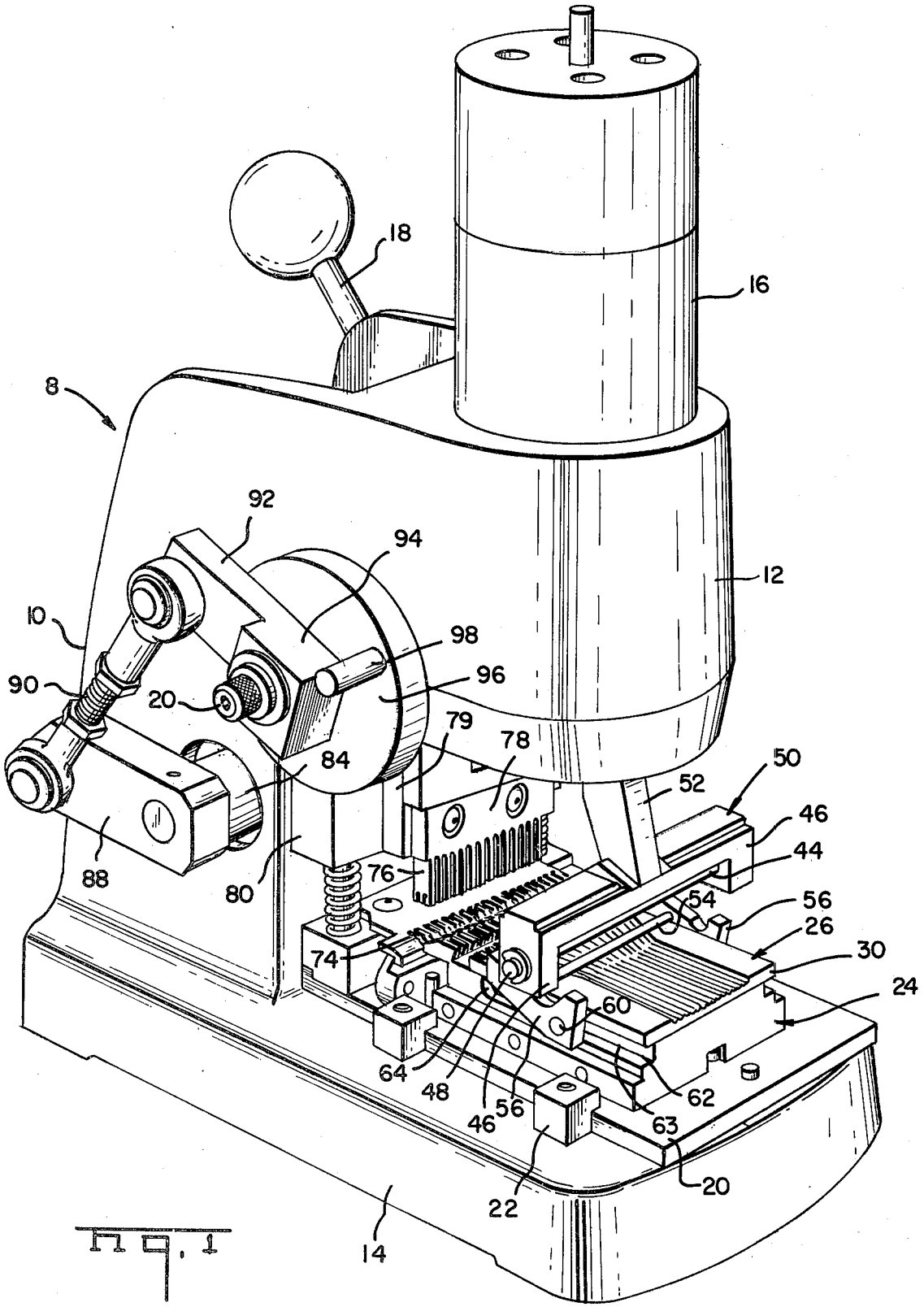
FIG. 1 is a perspective view of a preferred embodiment of the invention, this view showing the positions of the parts prior to the commencement of operation.

The particular embodiment of the invention disclosed herein serves to spread apart or deploy a plurality of wires 2 and locate the end portions of the wires in alignment with the wire-receiving portions of terminals which are contained in an electrical connector 6. The particular connector shown is of the type fully disclosed in U.S. Pat. No. 3,760,335 and will be described here only to the extent necessary for an understanding of the disclosed embodiment of the instant invention. The wire-receiving portions of the terminals are located in a row at spaced-apart locations 4, the row extending transversely between the ends of the connector housing and the adjacent positions being separated from each other by barrier walls 7. The barrier walls are spaced from a flange 9 which extends outwardly from the housing midway between the mating face 11 and the rearward face 13.

The disclosed apparatus 8 comprises a manually operated bench press having frame means consisting of a vertically extending neck portion 10, a horizontally extending upper arm 12, and a horizontally extending lower arm 14. A reciprocable ram 16 is slidably contained in the upper arm 10 and can be moved towards and away from the lower arm 14 by a handle 18 which is coupled to a shaft extending through the press frame, the end portion of this shaft being shown at 20 in FIG. 1. When the handle is swung through a clockwise arc as viewed in FIG. 1, the shaft is rotated in a clockwise direction and a gear wheel keyed to the shaft and contained in the arm 12 meshes with a rack bar integral with the ram 16 to drive the ram downwardly. A bench press of this general type is described more fully in the above-identified U.S. Pat. No. 4,043,017 referred to above.

Figure 4:
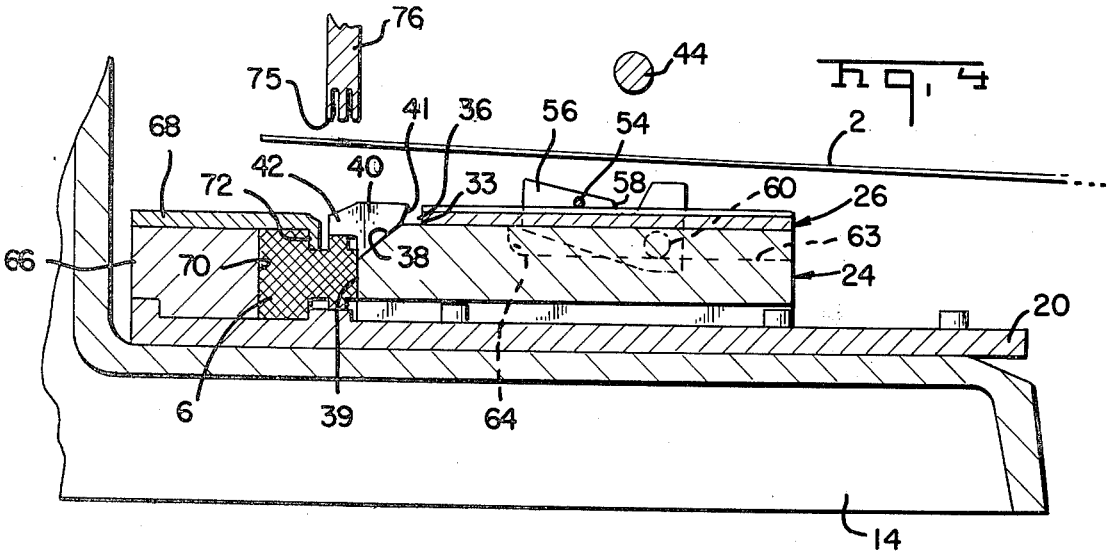
FIG. 4 is a sectional view taken along the lines 4—4 of FIG. 3.

A rectangular mounting plate 20 is clamped to the surface of the lower arm 14 by suitable clamping blocks 22 and a support block 24 is supported on the surface of the plate 20. This support block extends generally towards the neck portion 20 of the press frame and has a templet plate 26 mounted on its upper surface. Templet plate 26 has a plurality of wire-receiving recesses in its surface which extend in parallel side-by-side relationship as shown at 28 from the outer end 30 of the templet partially towards the inner end thereof. These recesses diverge from each other as shown at 34, FIG. 3, and are spaced-apart at the inner end of the templet by distances corresponding to the spacing between the positions 4 of the connector 6. As best shown in FIG. 4, the inner end 33 of the templet plate is spaced from the inner end 39 of the block 24 and spaced-apart barriers 40 extend from the end portion of the block 24 and beyond the face 39 of the block as shown at 42. The spacing between adjacent barriers 40 is the same as the spacing between the portions 34 of the wire-receiving grooves in the templet plate so that portions of wires disposed in the grooves will also be received between adjacent barriers 40. It should be noted in FIG. 4 that the surface of the block 24 between adjacent barriers 40 is inclined downwardly towards the end or face 39 of the block for reasons which will become apparent.

Figure 5:
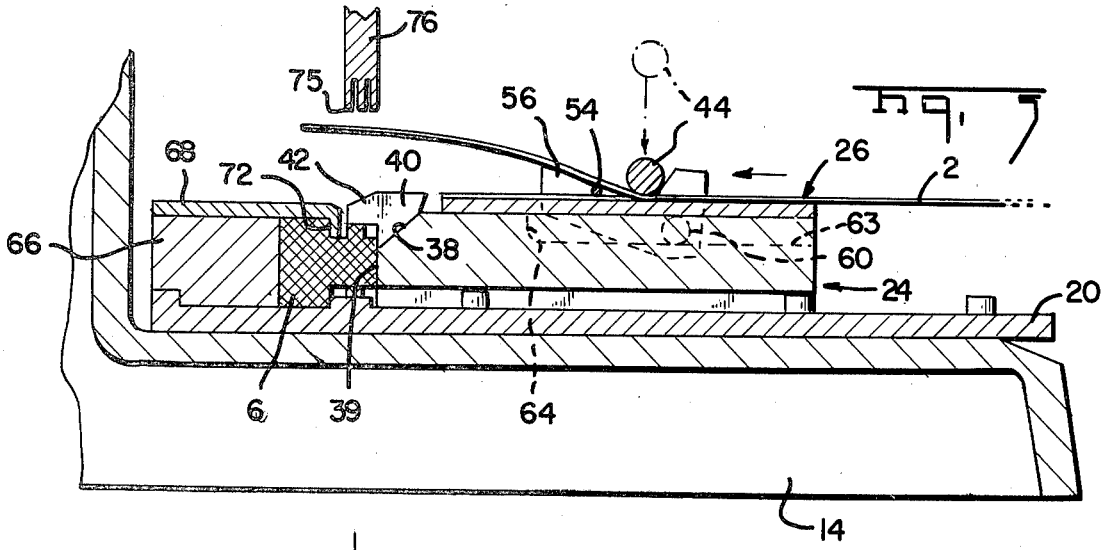
FIGS. 5 and 6 are views similar to FIG. 4 but showing the positions of the parts during successive stages of the operating cycle of the apparatus.
Figure 6:
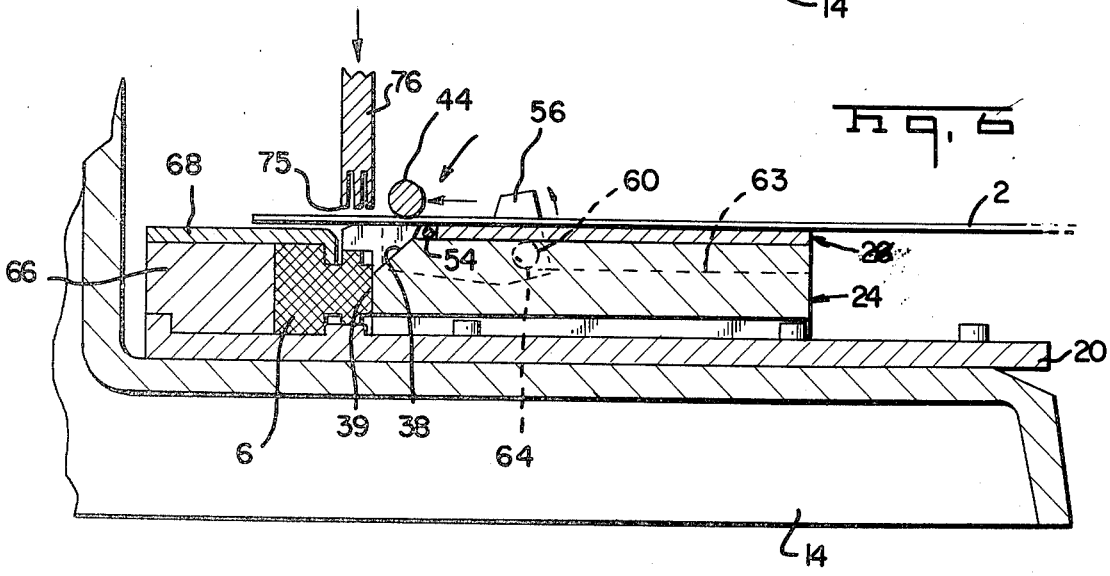

The individual wires 2 are pressed into the grooves 28, 34 in the templet by a roller 44 which in FIG. 4 is spaced above the surface of the templet and which extends transversely with respect to the grooves 28. The roller 44 has reduced diameter ends 48 which are received in the spaced-apart arms 46 of a yoke 50 which is integral with the lower end of a single arm 52 extending downwardly from the interior of the upper arm 12 of the press frame. The upper end of the arm 52 is coupled to the lower end of the ram 16 in the manner described in the above-identified U.S. Pat. No. 4,043,017. For purposes of the instant disclosure, it is sufficient to say that this coupling is such that when the ram 16 moves downwardly from the position of FIG. 1, the roller 44 moves downwardly until it is against the surface of the templet 26 and upon further downward movement of the ram 16, the arm 52 swings through a clockwise arc as viewed in FIG. 1 so that the roller 44 moves across the surface of the templet plate as shown in FIGS. 5 and 6. These movements of the roller during downward movement of the ram are achieved by a cam type coupling between the upper end of the arm 52 and the ram 16.

Figure 7:
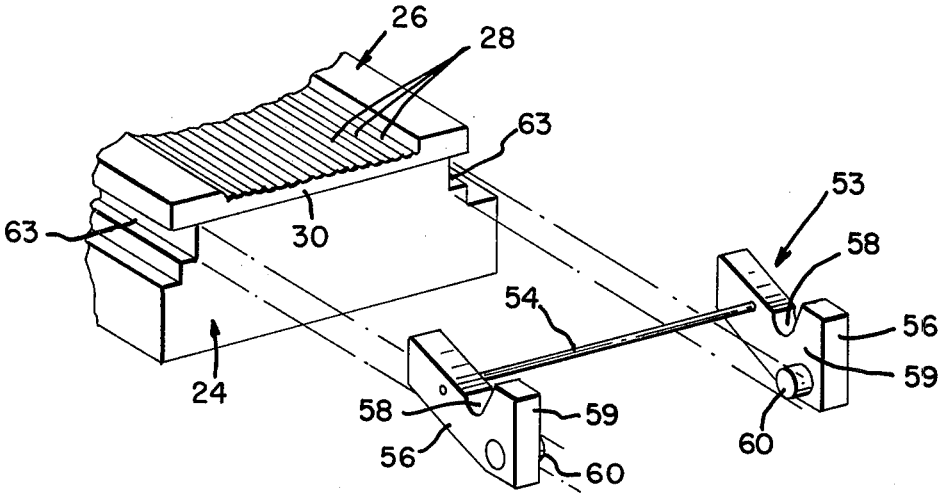
FIG. 7 is a fragmentary perspective view showing a portion of the templet plate and the wire controlling or controller means.

The wire controlling means 53 in accordance with the invention, FIG. 7, comprises a relatively thin bar 54 which extends transversely across the surface of the templet plate 26 in front of the roller 44, that is, between the roller 44 and the inner end 33 of the templet plate. The ends of the bar 54 are mounted in spaced-apart carriage blocks 56 which are disposed against the sides of the block 24 as shown best in FIG. 1. Carriage blocks 56 have notches 58 in their upwardly facing surfaces or edges which are dimensioned to receive the end portions of the roller 44 as shown in FIG. 5 and the opposed faces 59 of the blocks 56 have inwardly directed pins 60 extending therefrom. These pins are received in guide channels 62 on the sides of the block 24, which are formed by overhanging side edge portions of the templet 26, and upwardly facing surfaces 63 on the sides of the block 24. The grooves 63 have inner ends 64 which are spaced from the inner end 39 of the block 24 and which limit the leftward travel as viewed in FIGS. 4–6 of the carriage on the templet and block 24 when the carriage or controller assembly 53 reaches the limit of its leftward travel, the controller bar 54 will move into a recess 36 which is defined by the inner end 33 of the templet plate and the leftwardly facing ends 41 of the barriers 40. Movement of the bar 54 into the recess 36 is brought about by the roller 44 and its relationship to the recesses 58 in the blocks 56. As shown in FIG. 5, when the roller 44 has its ends in the recesses 58, portions of the surface of the roller bear against left hand portions of the recesses 58 as viewed in FIG. 5 and it is this relationship of the roller to the recess which causes the controller means 53 to move leftwardly from the position of FIG. 5 as the roller moves leftwardly. When the pins 60 reach the ends of the grooves 63 in the sides of the block 24, the continuing movement of the roller imparts a moment to the controller assembly 53 and under the influence of this moment, the entire assembly swings counterclockwise relative to an axis extending through the centers of the pins 60. During such arcuate movement of the controller assembly 53, the controller bar moves into the recess 36 and the roller continues its leftward movement as shown in FIG. 6.

The operation of the wire spreading means of the apparatus 8 and the function and purpose of the wire controller means 53 can be explained from the description presented above as follows. At the beginning of the operating cycle, the parts will be in the positions of FIGS. 1 and 4 and the operator places the wires as shown in FIG. 4 with their axes extending above the surface of a templet and beneath the roller 44 and generally towards the inner end 33 of the templet plate. The wires extend beyond the templet plate and past a connector positioned in a connector locating means as described below. After locating the wires, the operator swings the handle 18 through a clockwise arc thereby causing the ram 16 to move downwardly to the position of FIG. 5 and bring the roller against the surface of the templet so that the wires are pressed against the templet and the ends of the roller will be received in the notches 58. Upon further downward movement of the press ram 16, the roller is caused to move from the position of FIG. 5 to the position of FIG. 6 and the roller carries with it for a portion of such movement the controller assembly 53. In other words, the controller slides along the templet and the support block 24 until the pins move against the inner ends 64 of the grooves or channels 62. At that time, the bar 54 falls into the transverse slot 36 and the roller continues its leftward movement until it is on the upper edges of the barriers 40 as shown in FIG. 6. During such movement of the roller, the wires are pressed into the grooves 24, 34 in accordance with the teachings of the above-identified U.S. Pat. No. 3,891,013.

During leftward movement of the roller from the position of FIG. 5, the wires will extend from beneath the roller over the surface of the controller bar 54 and the portions of each wire which are between the controller bar and the roller will be lifted as shown in FIG. 5 above the surface of the templet plate. During leftward movement of the controller carriage, the controller bar moves with the carriage and raises the wires above the surface and approximately aligns a portion of each wire with the groove in the templet into which it should be pressed. Specifically, the controller, in lifting the wires upwardly, tends to flex the portions of the wires which lie between the controller bar and the roller and as a result of this flexure, those portions of the wires are stressed somewhat and have a tendency to return towards the surface of the templet plate; in other words, the wires are resiliently biased downwardly as viewed in FIG. 5. As a further result, the wires tend to locate themselves in side-by-side relationship in the vicinity of the controller bar and roller and the randomness of the wires is controlled. When the wires are in side-by-side relationship on the controller bar, they will be in approximate alignment with the grooves on the templet plate, particularly while the roller and the controller are moving across the parallel portions 28 of the grooves. This effect continues as the roller and the controller move across the divergent portions 34 of the grooves. The beneficial end result is that misplacement of the wires is avoided.

In the drawing, all of the wires are shown as being in side-by-side relationship and when the wires are in an orderly relationship to each other as shown, the roller will serve to ensure proper placement of the wires in the grooves. Under other circumstances, the wires may be in disarray or they may extend laterally in front of the roller and under such circumstances, the controller is even more beneficial in preventing misplacement of the wires in the grooves. As the roller moves across the templet, the mere fact that the wires are raised by the rollers will, in part, bring them into alignment with the templet and the roller additionally serves to isolate a portion of each wire which lies between the controller and roller so that it will be such to the desired influence of the roller.

As previously mentioned, the improved wire deploying or spreading means in accordance with the invention is incorporated into the apparatus 8 which also has insertion means for inserting the wires into the terminals in the connector 6. Accordingly, the positioning means for the connector 6 is shown in FIGS. 4–6 to comprise a positioning block 66 mounted on the inner end of the plate 20. Block 66 has a face 70 which is opposed to the end 39 of the block 24, the spacing between the faces 70 and 39 being such that the connector 6 can be positioned therebetween as shown in FIG. 4. The upper ends of the barriers 7 of the connector are located against the downwardly facing surfaces of the projecting portions 42 of the barriers 40. The connector 6 is also held or positioned by means of a plate 68 secured by suitable fasteners to the upper surface of the block 66. This plate extends rightwardly as viewed in FIG. 4 over the frontal portion of the connector and has a depending flange 72 on its end which is disposed between the rearwardly facing surface of the flange 9 of the connector and the barriers 7 of the connector. Slots 74 are provided in the plate 68 and these slots extend into the flange portion 72 of the plate. The slots are in alignment with the spaces between the barriers 40 of the plate 24 and the inner ends of these slots serve as fixed shearing edges in cooperation with movable shearing edges 75 on the insertion punches described below. In general, the insertion means, the connector positioning means, and the shearing or wire trimming means may be in accordance with the teachings of the wire insertion apparatus disclosed in the above-identified U.S. Pat. No. 3,760,335.

After the wires have been deployed by the roller and the controller as described above, the ends will extend leftwardly as shown in FIG. 6 over the upper surface of the plate 68 and the individual wires will be in alignment with the terminals in the connector. The wires are trimmed and inserted into the terminals by means of spaced-apart shearing and inserting punches 76 which extend from and are integral with a block 78 secured to a tool mounting block 79. Tool mounting block 79 is secured to turn to a cross end 80 which is slidably mounted on posts 81 which extend from the previously identified block 66. The cross end is resiliently biased upwardly to the position of FIG. 8 by springs 83 which are interposed between the upper surface of the plate 68 and the downwardly facing surface of the cross head.

Figure 8:
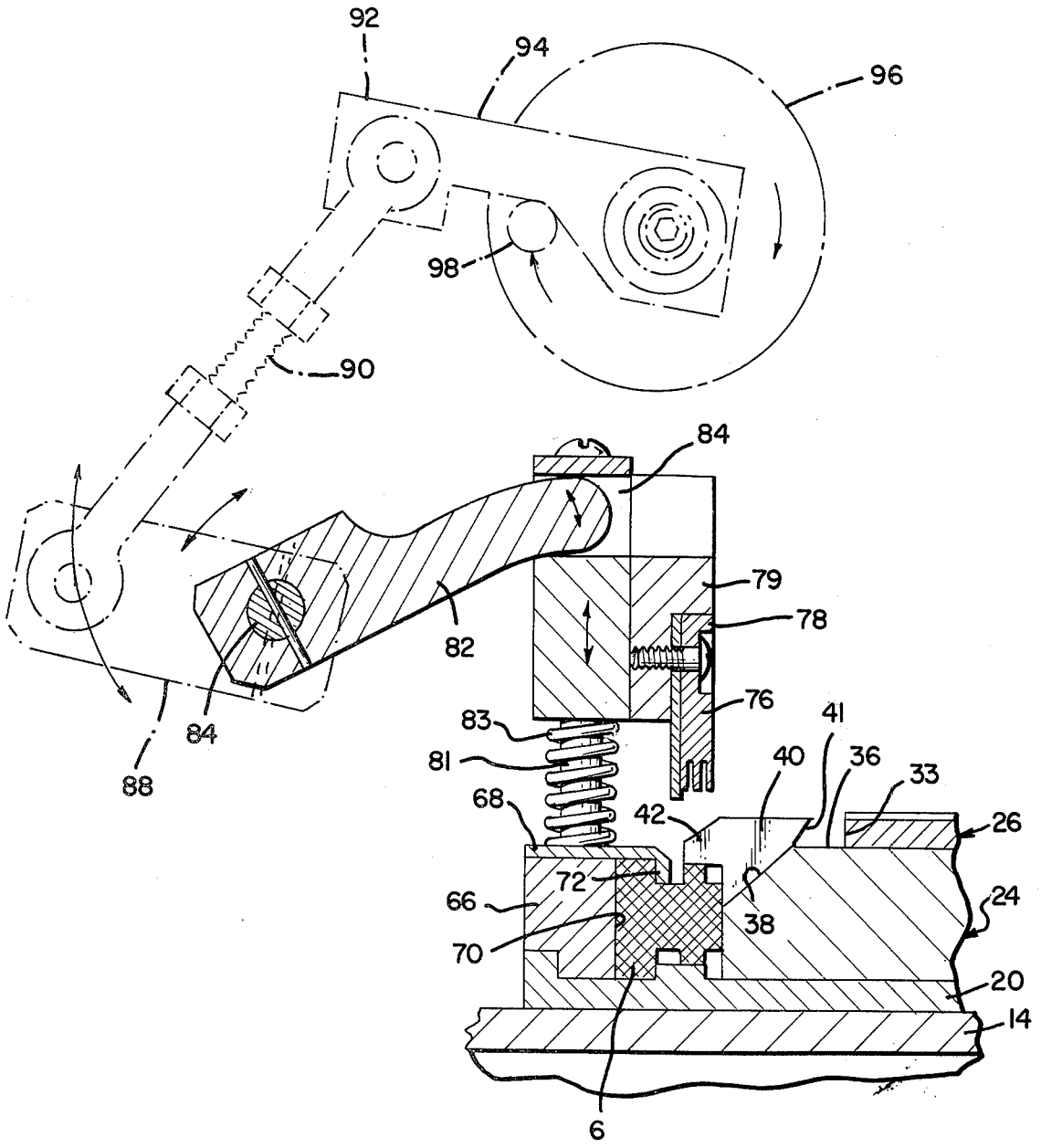
FIG. 8 is a fragmentary side view illustrating the actuating means for the insertion tooling of the apparatus.

The cross head and the insertion punches are moved downwardly during the final portion of the downward stroke of the ram 16 by a lever 82 having an end portion which extends into aligned recess 84 in the cross head and the tooling block 79, see FIG. 8. Lever 82 is fixed by a pin as shown in FIG. 8 to a shaft 86 which is journaled in a suitable bearing fixed to the press frame (not specifically shown). Shaft 86, in turn, extends from the neck portion 10 of the press and has a lever 88 fixed to its end by a suitable pin as shown. The end of lever 88 is pivotally connected to one end of a link 90 and the other end of this link is pivotally connected to an arm 92 which extends from a bearing block 94 through which the shaft 20 extends. Shaft 20 is freely rotatable in bearing block 94 so that the block will not be rotated or otherwise moved when the shaft 20 rotates. A circular plate is keyed or otherwise secured to the shaft 20 adjacent to the bearing block 94 and a pin 98 extends from this plate for engagement with the arm 92. The arrangement is such that during the final stages of the downward stroke of the ram, the pin 98 will engage the arm 92 and swing this arm through a slight clockwise arc as viewed in FIG. 1. Clockwise movement of the arm 92 is translated into clockwise movement of the arm 88 which, in turn, causes the shaft 86 to rotate in a clockwise direction thereby moving the arm 82 downwardly from the position of FIG. 8.

It will thus be apparent that after the wires have been deployed on the templet and aligned with the terminals on the connector the insertion punches 76 will be moved downwardly during the final portion of the downward stroke of the ram and the wires will be trimmed and inserted into the terminals in the connector.

The ram can then be returned to its raised position by returning the lever to the position of FIG. 1. After removal of the connector from the insertion zone, the controller assembly 53 can then be returned to its starting position and the apparatus prepared for the next cycle. It should be pointed out that removal of the connector 10 with the wires extending therefrom is accomplished by moving the plate 34 rightwardly from the position shown in the drawings to provide clearance for the wires which are now attached to the connector.

As shown in FIG. 2, the connector 6 has two rows of terminals which are attached to receive wires and only one row is connected to wires between apparatus shown in FIG. 1. The other wires may be connected to the terminal positions by other suitable tooling such as a hand tool.

The principles of the invention can be used with a wide variety of connectors, for example, single row connectors of the type disclosed in FIG. 1 of U.S. Pat. No. 4,043,017.

I claim:

1. Apparatus for deploying and locating a plurality of wires in side-by-side relationship comprising:

a templet having a wire supporting surface extending thereacross, a plurality of wire-receiving recess means extending across said surface in one direction, a wire pressing member extending across said surface transversely of said one direction, said wire pressing member being movable across said surface in said one direction, a wire controller disposed beside, and in advance of, said pressing member, said controller being movable across said surface in unison with said pressing member, said controller providing a wire deflecting surface which extends upwardly relative to said wire supporting surface whereby, upon placement of intermediate portions of said wires on said wire supporting surface in alignment with said recess means and beneath said pressing member with said wires extending over said wire controller, and upon movement of said wire pressing member and said wire controller over said surface, said wires are selectively pressed into said recess means by said pressing member, said controller serving to deflect portions of said wires which are adjacent to said pressing member upwardly and away from said surface and to align said wires with the predetermined recess means into which they are to be pressed.

2. Apparatus as set forth in claim 1, said wire pressing member comprising a wire pressing roller.

3. Apparatus as set forth in claim 2, said wire controller comprising a wire controlling bar, said wire pressing roller and said wire controlling bar being on parallel spaced-apart axes.

4. Apparatus for deploying a plurality of wires and locating end portions of said wires in side-by-side relationship, said apparatus comprising:

a templet having a wire supporting surface extending thereacross in one direction to one end of said surface, a plurality of wire-receiving recesses extending across said surface in said one direction, a wire pressing member, said pressing member extending across said wire supporting surface transversely of said one direction and being normally spaced from said wire supporting surface and being normally remote from said one end of said surface, a wire controller disposed beside, and being spaced from, said pressing member and between said pressing member and said one end, said controller being on said surface and providing wire deflecting surface portions which extend away from said wire supporting surface, and actuating means for moving said wire pressing member towards and against said wire supporting surface and thereafter moving said pressing member and said wire controlling member across said surface in unison towards said one end whereby, upon placement of said wires on said surface and beneath said pressing member with and in approximate alignment with said recesses and with portions of said wires extending over said deflecting surface portions and generally towards said one end, and upon moving said pressing member and said controller towards said one end by said actuator, said wires are selectively pressed into said recesses by said pressing member, said controller serving to deflect portions of said wires which are adjacent to said pressing member and to align said wires with the predetermined recesses into which they are to be pressed.

5. Apparatus, as set forth in claim 4, said wire pressing member comprising a wire pressing roller.

6. Apparatus, as set forth in claim 5, said wire controller comprising a bar.

7. Apparatus, as set forth in claim 6, and means for moving said controller bar away from said surface when said bar arrives at said one end.

8. Apparatus, as set forth in claim 6, said controller bar being attached to carrier means movably mounted on said supporting template for movement in said one direction, and said pressing member being engageable with said carrier means upon movement of said pressing member towards said supporting surface.

9. Apparatus, as set forth in claim 8, said actuating means comprising a press ram to which said pressing roller is attached.

* * * * *